US007081070B1

(12) United States Patent
Washington et al.

(10) Patent No.: US 7,081,070 B1
(45) Date of Patent: Jul. 25, 2006

(54) ARTICULATING EXERCISE BICYCLE PLATFORM

(75) Inventors: Kenneth R. Washington, 1136 Cordova Ave., Glendale, CA (US) 91207; Arthur L. Grebelsky, 1215 Viscano Dr., Glendale, CA (US) 91207; Clyde L. Tichenor, Somis, CA (US)

(73) Assignees: Kenneth R. Washington, Glendale, CA (US); Arthur L. Grebelsky, Glendale, CA (US)

( * ) Notice: Subject to any disclaimer, the term of this patent is extended or adjusted under 35 U.S.C. 154(b) by 0 days.

(21) Appl. No.: 10/880,310

(22) Filed: Jun. 30, 2004

(51) Int. Cl.
*A63B 22/06* (2006.01)

(52) U.S. Cl. ..... 482/57; 434/61

(58) Field of Classification Search ..... 482/57, 482/111–113, 133, 139, 142, 146; 434/61; 472/130
See application file for complete search history.

(56) References Cited

U.S. PATENT DOCUMENTS 3,207,510 A * 9/1965 Gibson ..... 482/71
3,750,479 A * 8/1973 Gause et al. ..... 73/379.07
4,478,407 A * 10/1984 Manabe ..... 472/60
4,605,220 A * 8/1986 Troxel ..... 482/79
5,035,418 A * 7/1991 Harabayashi ..... 482/62
5,240,417 A * 8/1993 Smithson et al. ..... 434/61
5,429,562 A * 7/1995 Milner ..... 482/51
5,533,899 A * 7/1996 Young ..... 434/61
5,533,935 A * 7/1996 Kast ..... 472/130
6,126,577 A * 10/2000 Chang ..... 482/57
6,322,480 B1 * 11/2001 Lim et al. ..... 482/57
6,855,096 B1 * 2/2005 Quiros Granados ..... 482/57

* cited by examiner

*Primary Examiner*—Jerome Donnelly
*Assistant Examiner*—Tam Nguyen
(74) *Attorney, Agent, or Firm*—Albert O. Cota

(57) ABSTRACT

An articulating platform (20) that is used to vary the longitudinal and lateral angular displacement of an exercise bicycle (22) mounted thereon. The platform includes a bicycle mounting base (24) configured to accept the footprint of a conventionally dimensioned exercise bicycle. The base (24) pivots in both a longitudinal axis and a lateral axis, thereby simulating uphill and downhill bicycle riding and turning when leaning sideways in a turning direction. The base (24) is preferably articulated by a D.C. motor drive system or optionally by a gear motor, pneumatic, hydraulic and worm drive systems each having controls for initiating directional articulation. A platform enclosure (40) supports the base and the drive system to provide a safety barrier for protecting moving components of the platform.

7 Claims, 11 Drawing Sheets

ARTICULATING EXERCISE BICYCLE PLATFORM

TECHNICAL FIELD

The present invention pertains to exercise bicycles in general, and more specifically to an articulating platform for mounting an exercise bicycle, with the platform varying in both longitudinal and lateral angular displacement to simulate up hill, down hill and turning environments.

BACKGROUND ART

Previously, many types of exercise bicycles have been used to provide an effective means to exercise a person's body while simulating some of the physical attributes relating to actual bicycle riding The prior art listed below did not disclose patents that possess any of the novelty of the instant invention; however the following U.S. patents are considered related:

| U.S. Pat. No. | Inventor | Issue Date |
|---|---|---|
| 4,842,269 | Huang | Jun. 27, 1989 |
| 4,938,475 | Sargeant et al. | Jul. 3, 1990 |
| 4,976,424 | Sargeant et al. | Dec. 11, 1990 |
| 5,240,417 | Smithson et al. | Aug. 31, 1993 |
| 5,362,069 | Hall-Tipping | Nov. 8, 1994 |
| 6,561,952 | Wu | May 13, 2003 |

Huang in U.S. Pat. No. 4,842,269 teaches a stationary exercise bicycle including a foot-exercise mechanism and a hand-exercise mechanism that simultaneously move in a reciprocating manner. The height of the hand-exercise mechanism and seat are adjustable so that they represent the proper height and angle appropriate to accommodate a user.

U.S. Pat. No. 4,938,475 issued to Sargeant et al. is for an exercising apparatus for supporting a bicycle with the front wheel removed. A flywheel and variable load means simulate inertia. Frictional losses are determined by the deceleration of the wheel subtracted from variable load means. The heart beat rate of a rider is monitored and controlled to maintain a rate within a predetermined limits.

Sargeant et al. in U.S. Pat. No. 4,976,424 is a divisional of the above patent of Sargeant et al. including another embodiment of the same disclosure.

Smithson et al. in U.S. Pat. No. 5,240,417 teaches a system for simulating bicycle riding using a conventional appearing bicycle in electrical communication with a video display that visually reflects changes in speed and position in response to a rider's pivotal movements. A computer adjusts the position of an animated bicycle on a track considering the influence of the forces of nature on the bicycle and user.

U.S. Pat. No. 5,362,069 issued to Hall-Tipping teaches a device that permits a person to play a video game and operate an exercise bicycle simultaneously. Pedal speed and heart rate are monitored, thus affecting the play of the game. If the aerobic level is too low, it is more difficult to play the game which encourages the user to increase the output of the exercise device.

Wu in U.S. Pat. No. 6,561,952 discloses a turning control device for a virtual stationary bicycle having a video monitor with a computer program attached showing images of a rider on a road. A control case having a sensor for sending signals is attached to the handle of the bicycle. The case sends signals so that the video monitor shows images of the rider on the bicycle moving in directions, thereby permitting the rider to feel as though they were riding on a road.

DISCLOSURE OF THE INVENTION

Exercise bicycles are in common usage today as physical fitness is of great importance to a large group of people who are concerned with their own health and well being. While exercise bicycles provide the necessary physical exertion, the repetitious nature of riding a stationary bicycle can easily become monotonous. Therefore, the primary object of the invention is to add another dimension to exercise devices in the form of articulating an existing exercise bicycle in both a longitudinal and lateral direction which provides dynamic interest to the person riding the bicycle.

An important object of the invention is that the existing exercise bicycle is not modified or require changing the bicycle's structure in anyway. The exercise bicycle is simply placed on a platform and an electrical switch gear repository is fit over one of the handlebars to control the angular displacement of the bicycle by manually energizing the appropriate switch.

Another object of the invention is that a television set equipped with a VCR or DVD player may be viewed from the seat of the exercise bicycle. When a scene on a video tape or DVD with a road is shown, the person riding the bicycle may manually vary the angle of the bicycle by using the proper switch. The angular movement will correspond to the image shown on the television, thereby simulating the angular displacement of a bicycle that would be experienced if actually riding the bicycle on a road.

Still another object of the invention is that a microprocessor may be used to control the drive system in place of the manual switches. A video projector that also interfaces with the microprocessor may present recorded images on a screen in front of the person riding, showing a road that includes hills and curves. The microprocessor will automatically synchronize the appropriate angular movements of the bicycle to correspond with the view of the road on the screen.

Yet another object of the invention is the simplicity of its design as the bicycle mounting base is articulated using either simple pivots in the form of hinges, flex plates, radial rim tracks and the common axial rod type bearings, or a single ball pivot on a pedestal.

A further object of the invention is that the ability to create an angular movement of the bicycle is achieved by simply manipulating a switch, which by itself is sufficient to break the monotony of just pedaling a stationary bicycle in the same repetitive manner.

Since the bicycle mounting base is a flat platform with a raised lip on the perimeter, almost any type of exercise bicycle may be used in conjunction with the invention. An upright-style exercise bicycle is particularly well adapted to be employed, as in most cases legs are provided with resilient caps on the projecting ends. This style of bicycle fits the envelope properly and along with the weight of the bicycle itself and resilience of the leg caps, no further tie down is required to hold the bicycle in place.

These and other objects and advantages of the present invention will become apparent from the subsequent detailed description of the preferred embodiment and the appended claims taken in conjunction with the accompanying drawings.

BEST MODE FOR CARRYING OUT THE INVENTION

Figure 1:
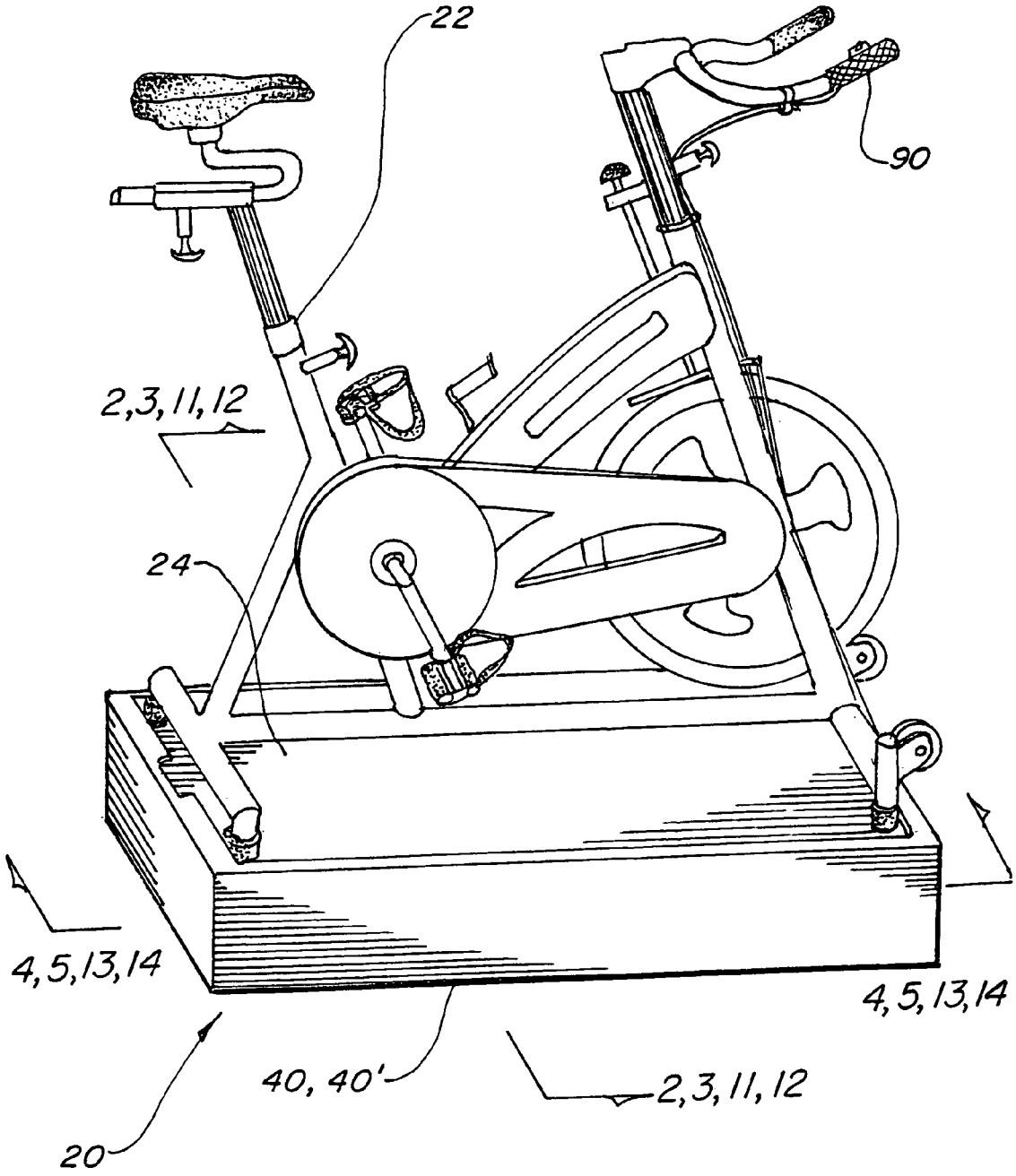
FIG. 1 is a partial isometric view of the articulating platform in the preferred embodiment with a representative exercise bicycle in place on the mounting base of the platform.
Figure 2:
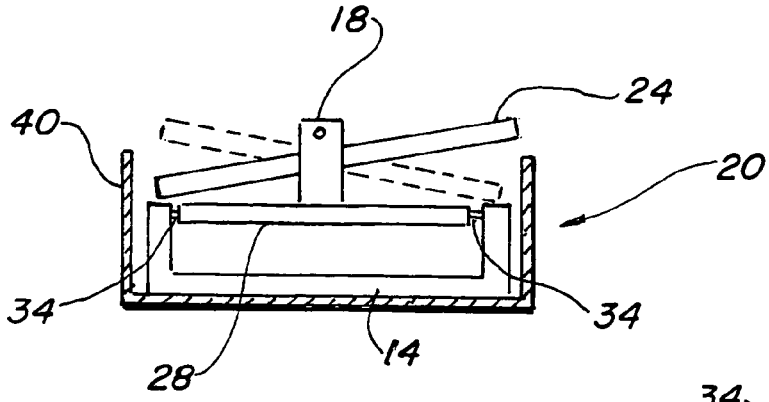
FIG. 2 is a cross-sectional view taken along lines 2—2 of FIG. 1 illustrating the exercise bicycle mounting base pivoted in the angular lateral axis plane and dash lines indicating the opposite angular position.
Figure 3:
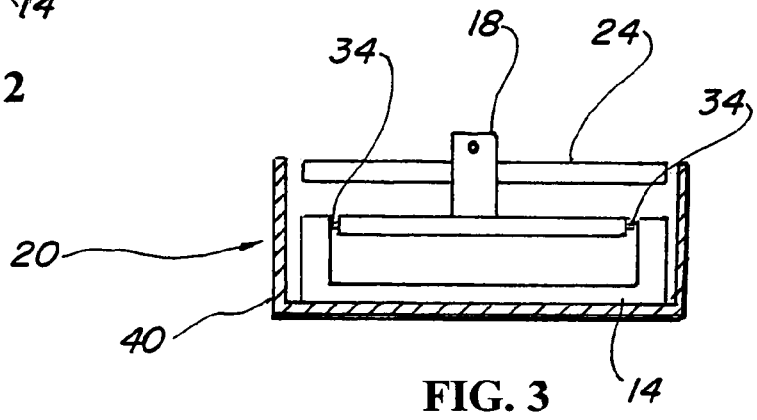
FIG. 3 is a cross-sectional view taken along lines 3—3 of FIG. 1 illustrating the exercise bicycle mounting base in the horizontal lateral plane.
Figure 4:
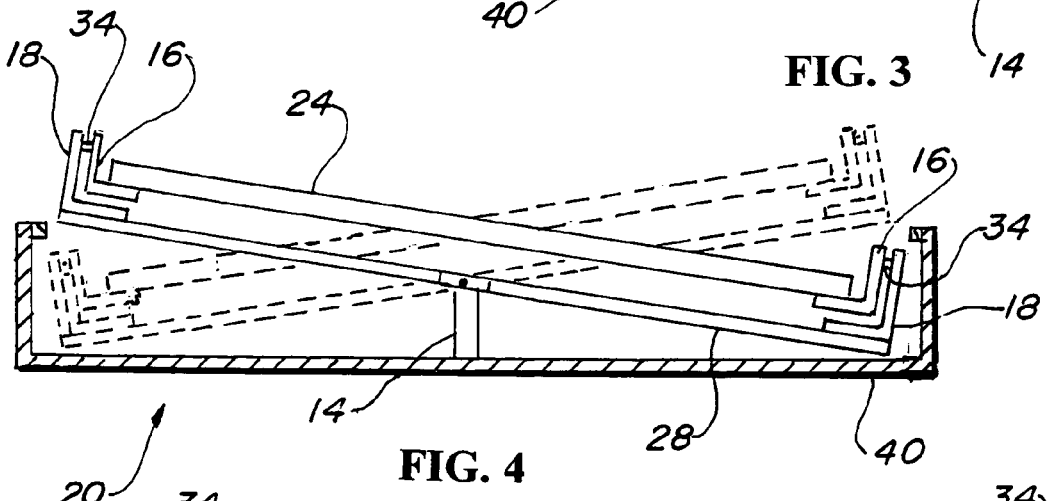
FIG. 4 is a cross-sectional view taken along lines 4—4 of FIG. 1 illustrating the exercise bicycle mounting base pivoted in the angular longitudinal axis plane and dash lines indicating the opposite angular position.
Figure 5:
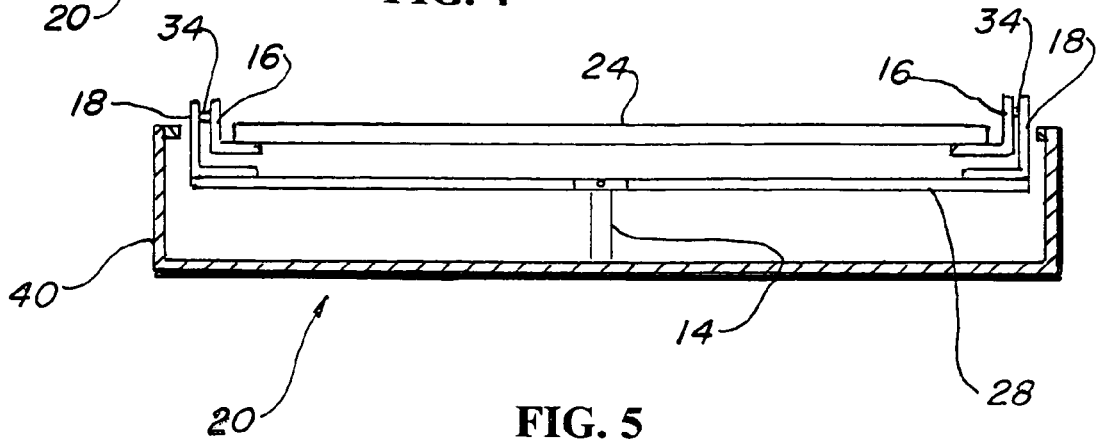
FIG. 5 is a cross-sectional view taken along lines 5—5 of FIG. 1 illustrating the exercise bicycle mounting base in the horizontal longitudinal plane.

The best mode for carrying out the invention is presented in terms of a preferred embodiment for an articulating platform 20, as shown in FIGS. 1 through 10, with other variations in both pivoting means and the articulating means are shown in the remaining figures. The articulating platform 20 is designed to vary the longitudinal and lateral angular displacement of an upright exercise bicycle 22 and consists of an articulating bicycle mounting base 24 configured to accept the footprint of the exercise bicycle 22 in both length and width. The base 24 is flat in the preferred embodiment, as shown in FIGS. 1–5 and 7. A raised lip 26 on the base 24 periphery may be added to assure the bicycle's 22 position on the bicycle mounting base 24, as illustrated in FIGS. 11–19.

The pivoting means are attached to the base 24, thereby permitting angular displacement of the base 24 in both a longitudinal axis and a lateral axis which simulates uphill and downhill bicycle riding, as well as bicycle turning by leaning sideways when in a turning direction. The preferred embodiment of the pivoting means employs the use of a pivot beam 28 having equal-length longitudinal legs 30 and lateral legs 32 configured in a cross shape, with the legs 30 and 32 at right angles to each other. The pivot beam 28 may be formed of any suitable material such as metal, fiberglass, wood reinforced thermoplastic, or the like, as long as it has the necessary structural integrity required for the application.

Figure 6:
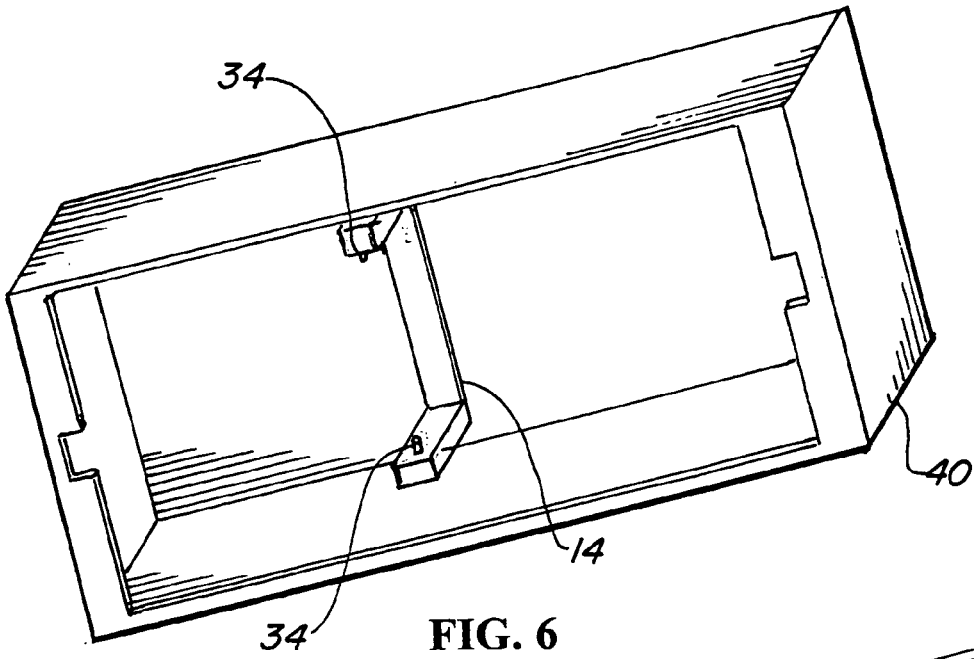
FIG. 6 is a partial isometric drawing of the platform enclosure in the preferred embodiment.
Figure 7:
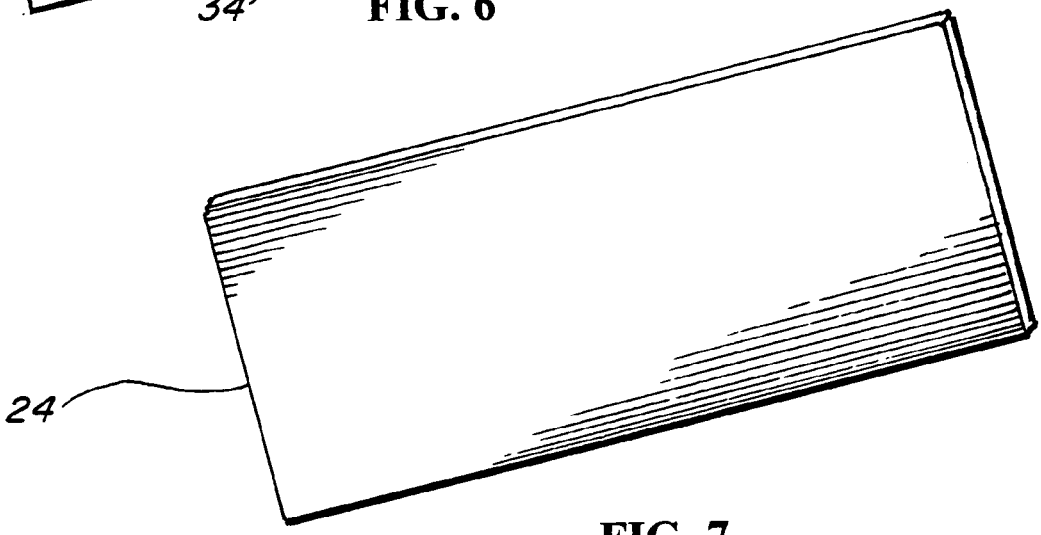
FIG. 7 is a partial isometric drawing of the bicycle mounting base in the preferred embodiment.
Figure 8:
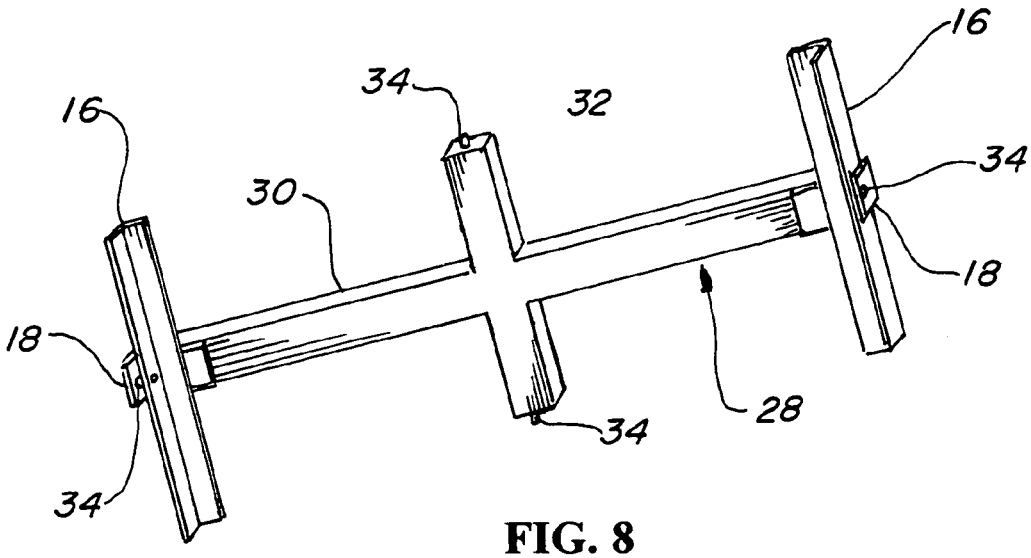
FIG. 8 is a partial isometric drawing of the pivot beam in the preferred embodiment.

FIG. 8 illustrates the beam 28 in the preferred embodiment, which is pivotally attached to a brace support yoke 14 which is in turn connected to a platform enclosure 40, as shown in FIG. 6. The brace support yoke 14 is in a U-shape and has sufficient structural integrity to support the exercise bicycle 22 along with a person riding the bicycle. The pivot beam lateral legs 32 include a spindle 34 attached onto each leg's distal end which interfaces with the brace support yoke 14, thus permitting the beam 28 to rotate in a longitudinal direction from horizontal, which imitates a bicycle riding uphill and downhill.

FIG. 8 also illustrates a pivot bracket 18 that is attached on each pivot beam longitudinal leg 30 distal end. The bicycle mounting base 24 includes a base support angle 16 on each end, as shown best in FIG. 10, with a spindle 34 disposed therebetween. The spindle 34 rotatably connects the pivot bracket 18 to the brace support angle 16, thereby permitting the bicycle mounting base 24 to rotate in a lateral direction from horizontal, which imitates a bicycle leaning sideways.

FIGS. 11–17 illustrate the beam 28 in other embodiments, which include a swiveling attachment on each distal end of the legs 30 and 32. The attachment may be any type of hinge mechanism, such as a flex plate, a radial rim track or an axial rod type bearing as illustrated in the drawings, which define the favored embodiment. With the axial rod type bearing, a spindle 34' extends from the end of each of the legs 30 and 32 with a bearing plate 36 attached on the mating component, which is illustrated in the drawings in its simplest form as a square plate with a bearing in the center and four holes for mounting. The swiveling attachment permits the beam 28 to rotate in a longitudinal direction from horizontal, which imitates a bicycle riding uphill and downhill, and rotating in a lateral direction from horizontal, which imitates a bicycle leaning sideways.

Figure 10:
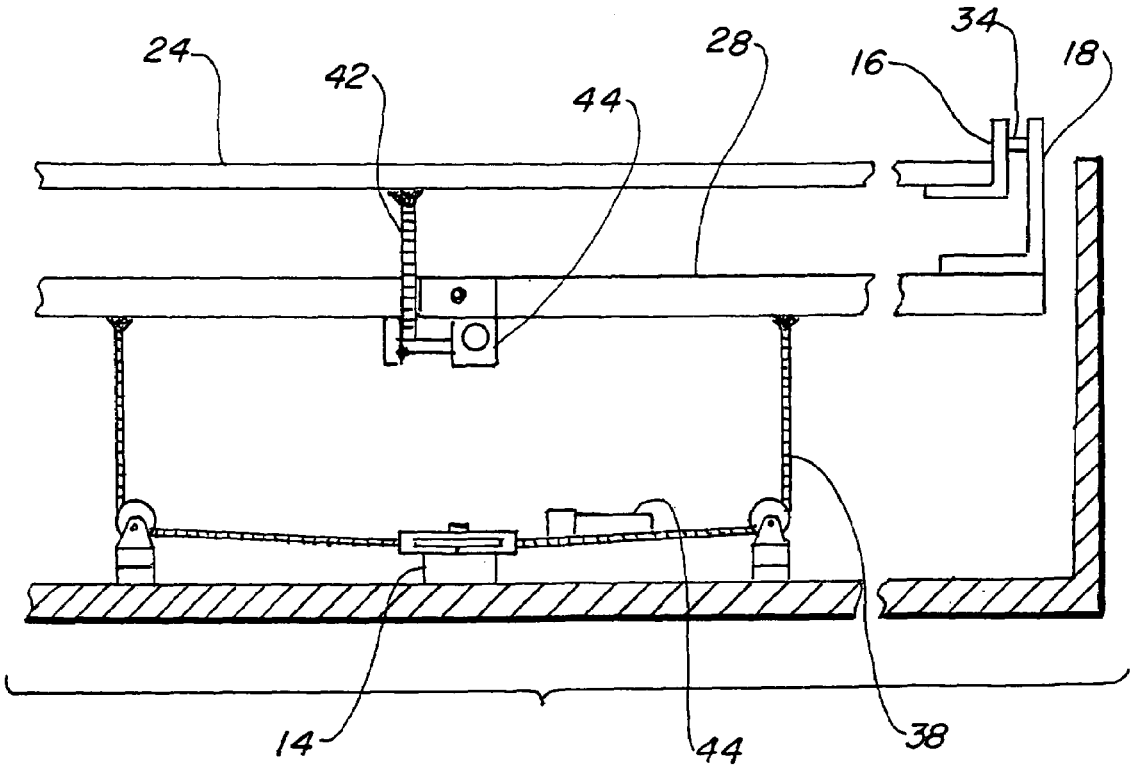
FIG. 10 is an arbitrary cross-sectional view of the preferred D.C. motor embodiment.
Figure 11:
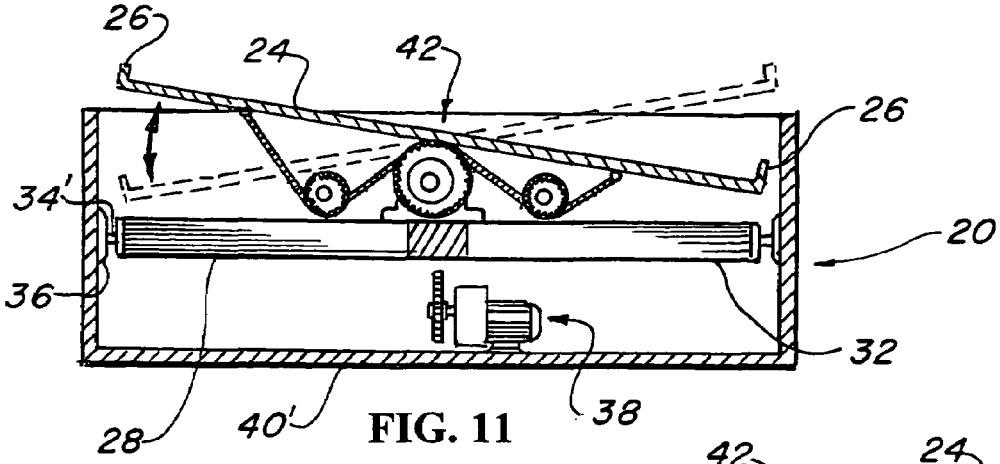
FIG. 11 is a cross-sectional view taken along lines 11—11 of FIG. 1 illustrating the exercise bicycle mounting base pivoted in the angular lateral axis plane and dash lines indicating the opposite angular position.
Figure 12:
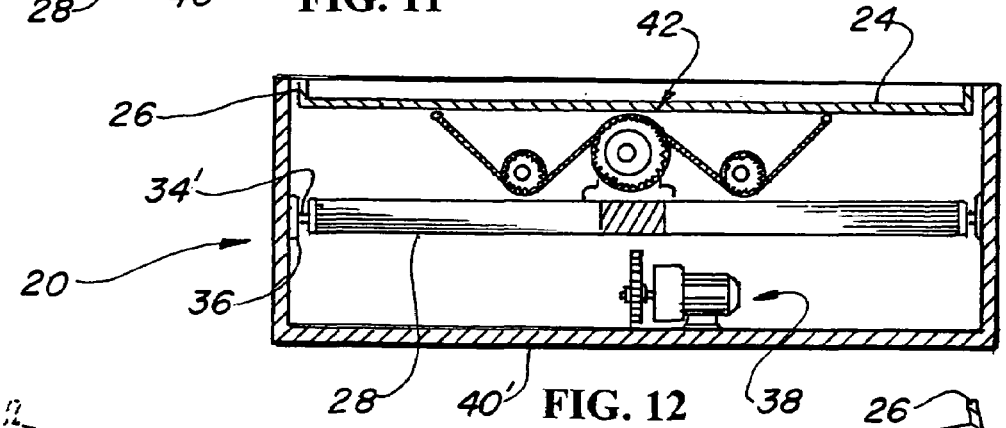
FIG. 12 is a cross-sectional view taken along lines 12—12 of FIG. 1 illustrating the exercise bicycle mounting base in the horizontal lateral plane.
Figure 13:
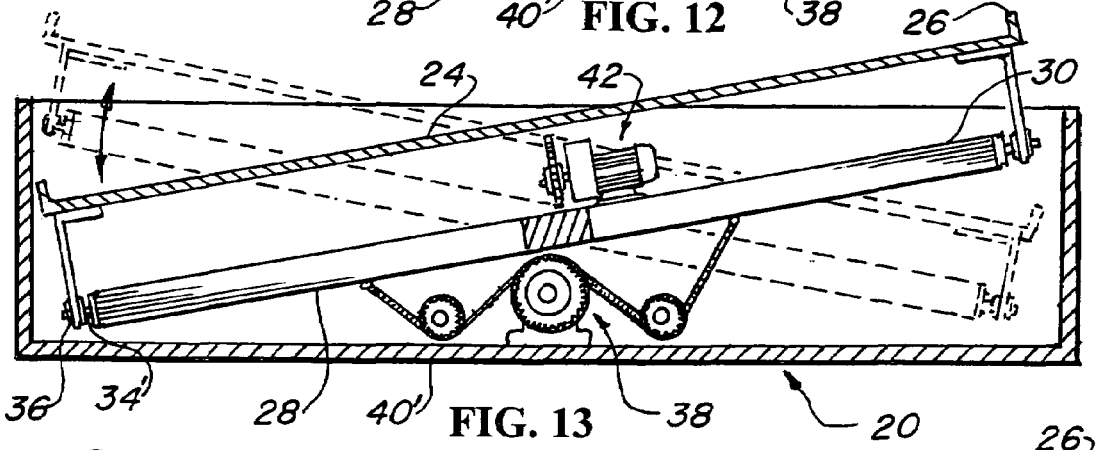
FIG. 13 is a cross-sectional view taken along lines 13—13 of FIG. 1 illustrating the exercise bicycle mounting base pivoted in the angular longitudinal axis plane and dash lines indicating the opposite angular position.
Figure 14:
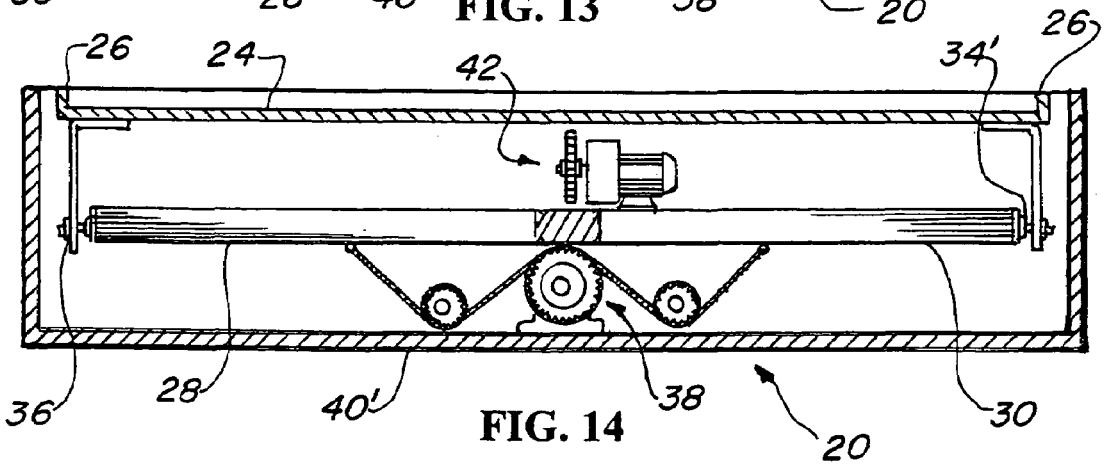
FIG. 14 is a cross-sectional view taken along lines 14—14 of FIG. 1 illustrating the exercise bicycle mounting base in the horizontal longitudinal plane.
Figure 15:
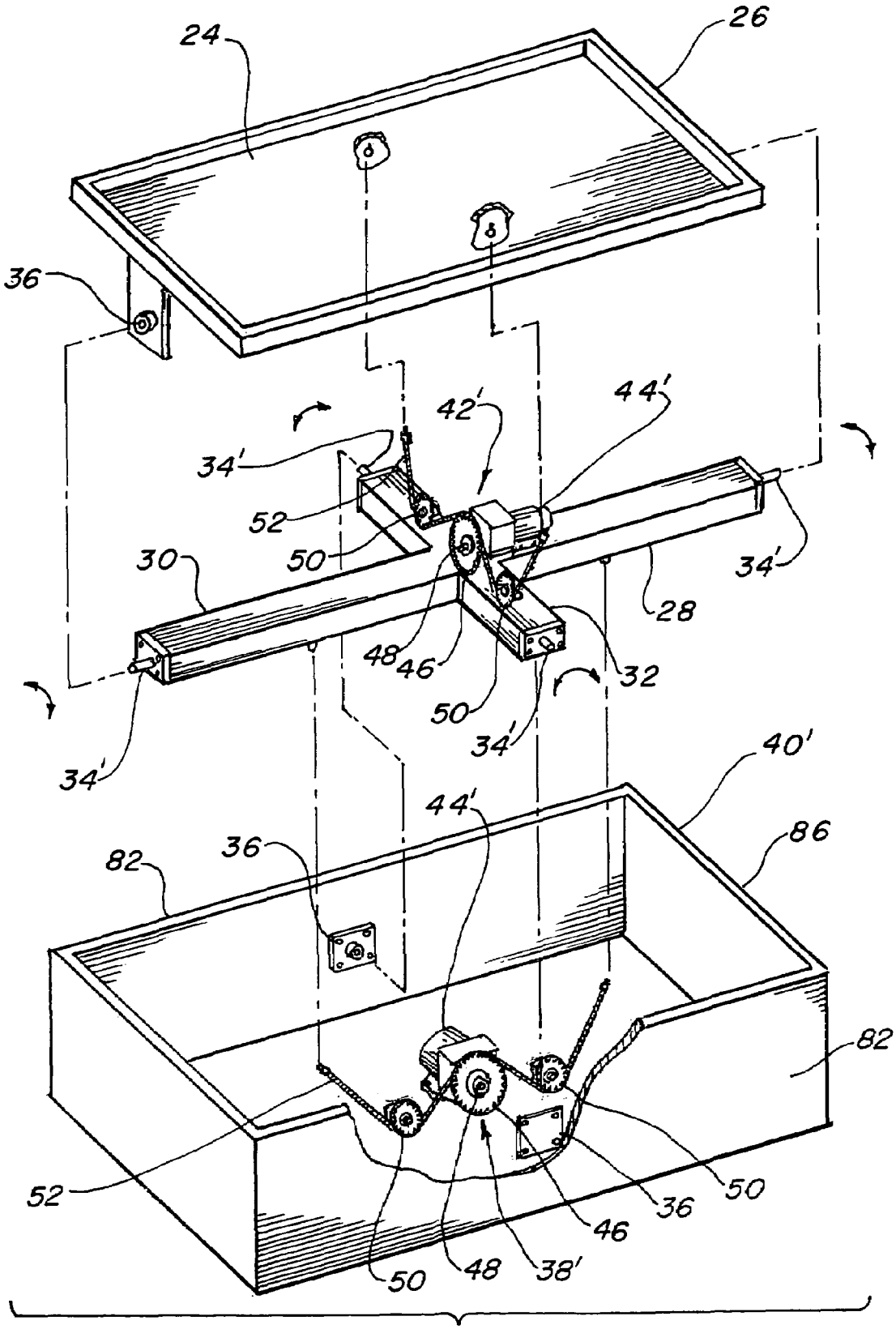
FIG. 15 is a partially exploded view of the platform in the chain drive embodiment of the articulating means.

In order to create the desired movement with the exercise bicycle platform 20, means for articulating the base in a longitudinal axis and a lateral axis, to simulate actual bicycle riding, are provided. In the preferred embodiment, as shown in FIG. 10, a D.C. motor drive system is utilized. The means for articulating the base consist of a first chain drive 38 attached between the platform enclosure 40 and the pivot beam 28, and a second chain drive 42 attached between the pivot beam 28 and the bicycle mounting base 24. Both the first chain drive 38 and the second chain drive 42 consist of a D.C. motor 44 attached to a roller chain 52 that engages a pair of idler roller chain sprockets 50. The roller chain 52 contiguously engages the D.C. motor 44 and idler roller chain sprockets 50 in concert, with each roller chain distal end attached to an appropriate articulating structure.

In another variation of the means for articulating the base, a gear motor drive, as shown in FIGS. 11–15, is utilized in which both the first chain drive 38' and second chain drive 42' consist of a low speed ratio gear motor 44', which have a roller chain sprocket 46 attached to their output shaft 48. A roller chain 52 and a pair of idler roller chain sprockets 50 are aligned adjacent to the gear motor 44'. The roller chain 52 winds around the gear motor roller chain sprocket 46 and simultaneously engages the idler roller chain sprockets 50, with each distal end of the chain 52 attached to an appropriate articulating structure, as described above.

Figure 16:
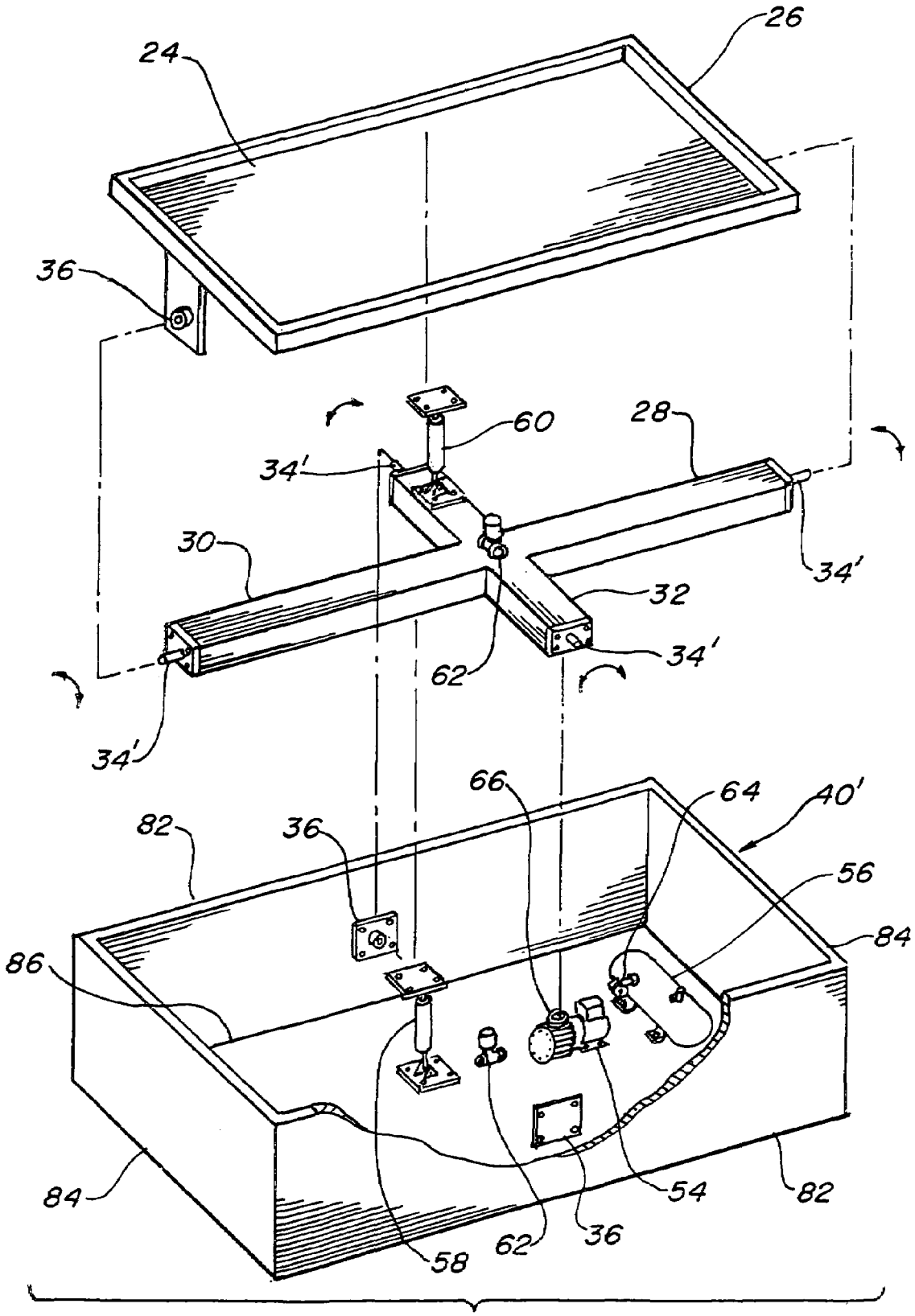
FIG. 16 is a partially exploded view of the platform in the pneumatic drive embodiment of the articulating means.

Another variation of the means for articulating the base consists of a pneumatic drive, as shown in FIG. 16, which is attached between the mounting base 24 and the pivot beam 28, for longitudinal articulation, and between the pivot beam 28 and platform enclosure 40, for lateral articulation. The pneumatic drive includes an air compressor 54 in pneumatic communication with a compressed air tank 56, and a first air cylinder 60 attached between the mounting base 24 and the pivot beam 28. A second air cylinder 58 is attached between the pivot beam 28 and the platform enclosure 40. To complete the pneumatic drive, a solenoid actuated valve 62, a pressure regulator 64 and a pressure switch 66 may also be utilized. While the above mentioned components are described and shown in the drawings, other components and accessories may be used or substituted while still falling within the scope of the patent.

Figure 19:
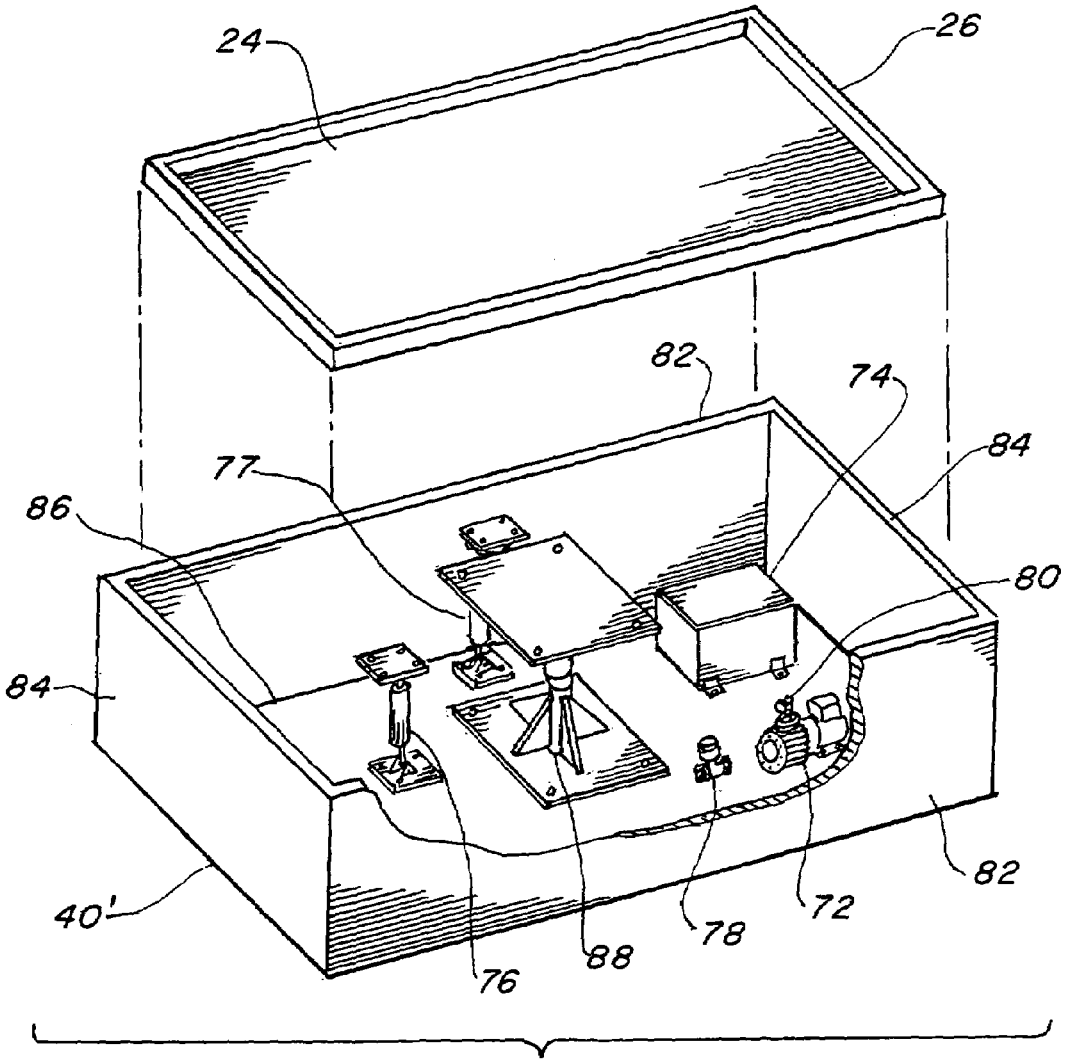
FIG. 19 is a partially exploded view of the platform in the ball joint embodiment of the pivoting means in combination with the hydraulic drive embodiment of the articulating means.

Yet another variation in the means for articulating the base consists of a hydraulic drive which may be attached between the mounting base 24 and the pivot beam 28, for lateral articulation, and between the pivot beam 28 and platform enclosure 40, for longitudinal articulation, which is not shown in the drawings, however may be located in the same manner as the pneumatic drive. FIG. 19 illustrates the hydraulic drive in another embodiment of the pivoting means, with the hydraulic drive attached between the mounting base 24 on a longitudinal end and the platform enclosure 40, for longitudinal articulation, and between the mounting base 24 on a lateral side and the platform enclosure 40, for lateral articulation.

The hydraulic drive incorporates a hydraulic pump 72 that is in hydraulic communication with a reservoir 74 on the pump's suction side. A first hydraulic cylinder 76 is attached between the mounting base 24 and the pivot beam 28, or platform enclosure 40', and a second hydraulic cylinder 78 is attached between either the pivot beam 28 or mounting base 24 and the platform enclosure 40'. To complete the hydraulic drive, a hydraulic valve 78 and a pressure relief valve 80 may be used, however their inclusion is not to limit other components which may be employed or substituted for cleanliness, safety and control of the system.

Figure 17:
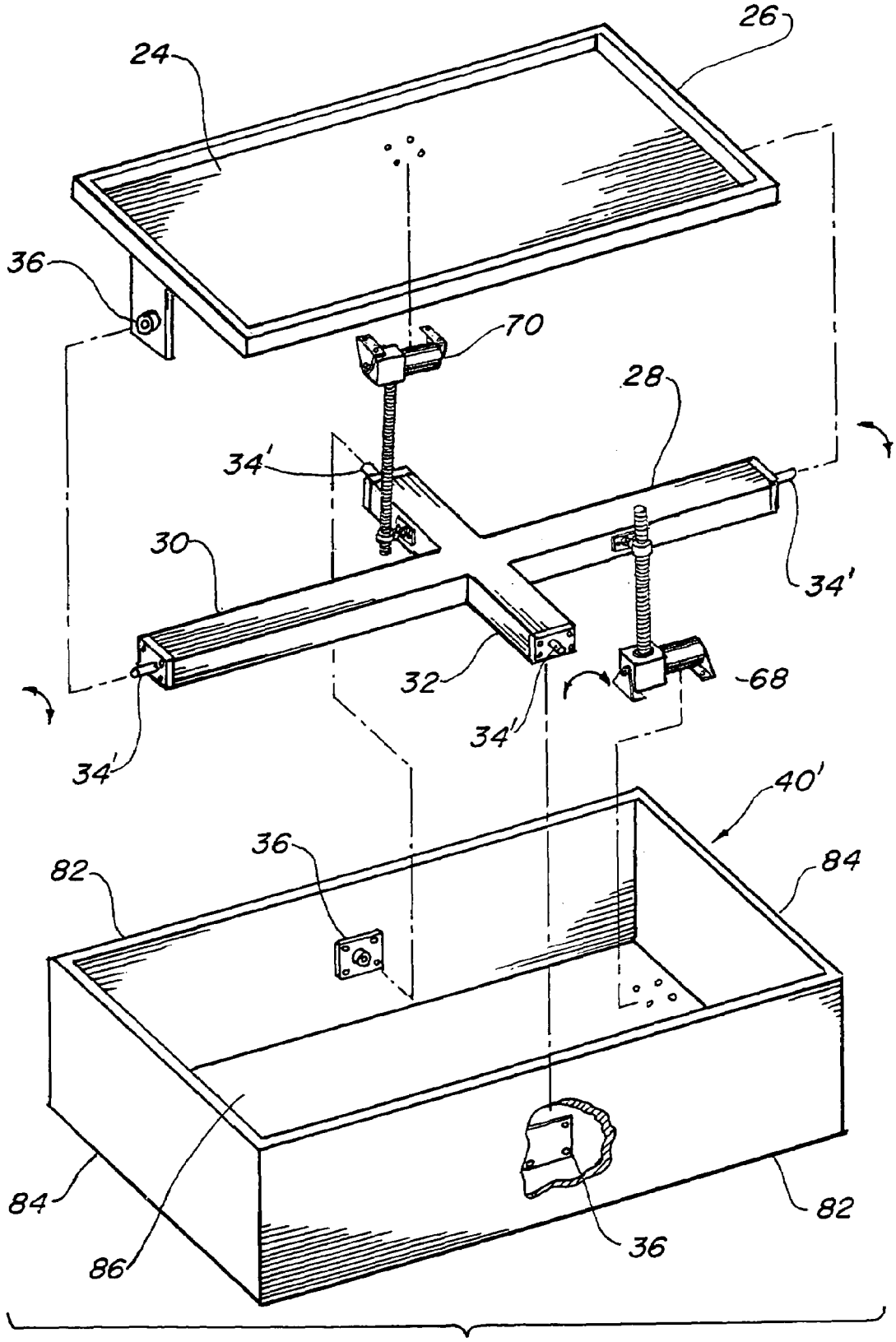
FIG. 17 is a partially exploded view of the platform in the worm screw drive embodiment of the articulating means.
Figure 18:
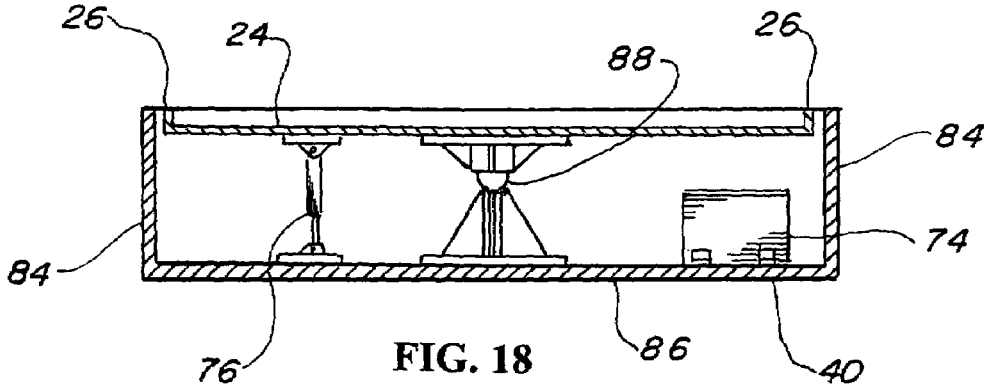
FIG. 18 is an arbitrary longitudinal cross sectional view of the platform in the ball joint embodiment of the pivoting means in combination with the hydraulic drive embodiment of the articulating means.

Still another variation in the means for articulating the base consists of a worm screw drive, as illustrated in FIG. 17, which attaches a first worm screw drive unit 68 between the mounting base 24 and the pivot beam 28 to achieve the desired longitudinal articulation. A second worm screw drive 70 is disposed between the pivot beam 28 and platform enclosure 40' to accomplish the lateral articulation of the mounting base 24. The worm screw drive is well known in the industry and functions using an electric low-speed gear motor that rotates an acme threaded shaft. A similarly threaded ring on the worm screw drive 68 is pivotally connected with a single ball pivot to the beam 28, as shown in FIG. 17, and when the shaft rotates, the beam 28 is urged in the direction of rotation. The first worm screw drive 68 gear motor is pivotally mounted on the platform enclosure 40 for the longitudinal movement, and the second worm screw drive 70 gear motor is inverted and pivotally mounted directly to the base 24 for lateral movement.

The platform enclosure 40 and 40', mentioned above, is made from a pair of opposed sides 82 and opposed ends 84 that are attached to a bottom 86, thus forming an open top tray with the bottom 86 configured to rest on a flat surface, as illustrated. The material of the enclosure 40 may be metal, wood, thermoplastic, fiberglass or any other material having suitable structural characteristics.

In another embodiment of the pivoting means, a ball joint pivot stand 88 may be utilized, as shown in FIG. 19, which is jointly attached to the bike mounting base 24 and the platform enclosure 40' in a centrally located position. This embodiment eliminates the necessity of the pivot beam 28, as the actuators attach directly from the enclosure 40' to the base 24, and is compatible with all of the embodiments of the pivoting means, including the chain drive system, pneumatic system, hydraulic system, and the worm screw drive system.

Figure 9:
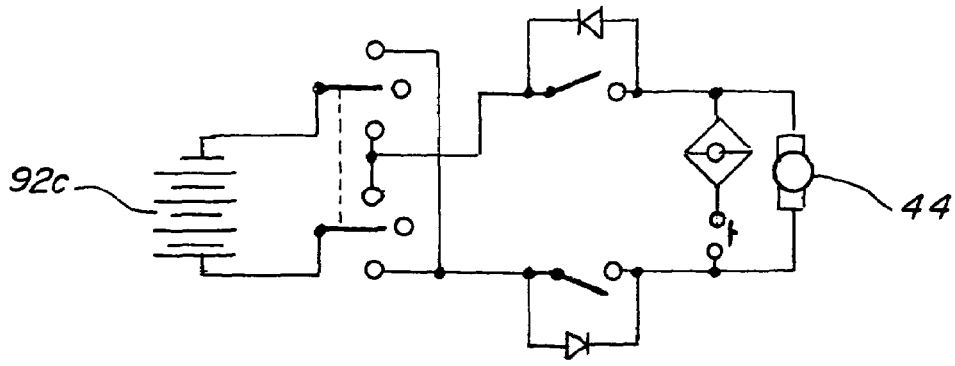
FIG. 9 is an electrical schematic diagram of the electrical switch gear in the preferred D.C. motor embodiment.
Figure 20:
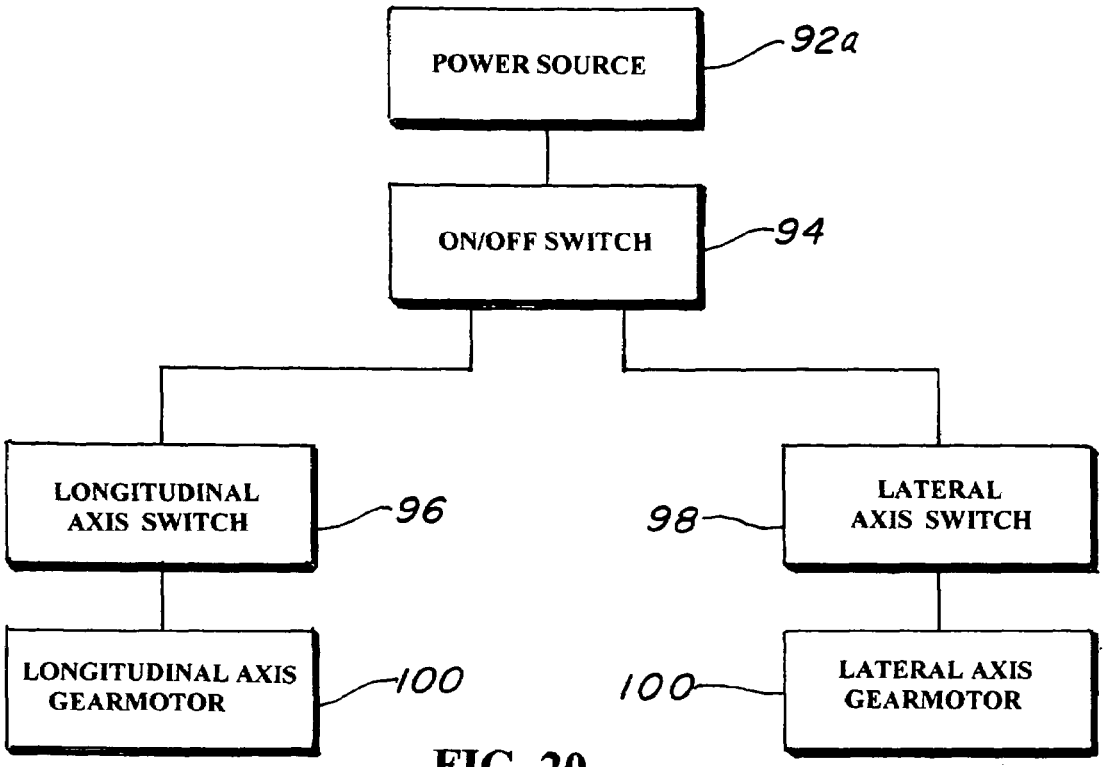
FIG. 20 is a block diagram of the electrical switch gear for actuating the articulating means in the chain drive embodiment.
Figure 21:
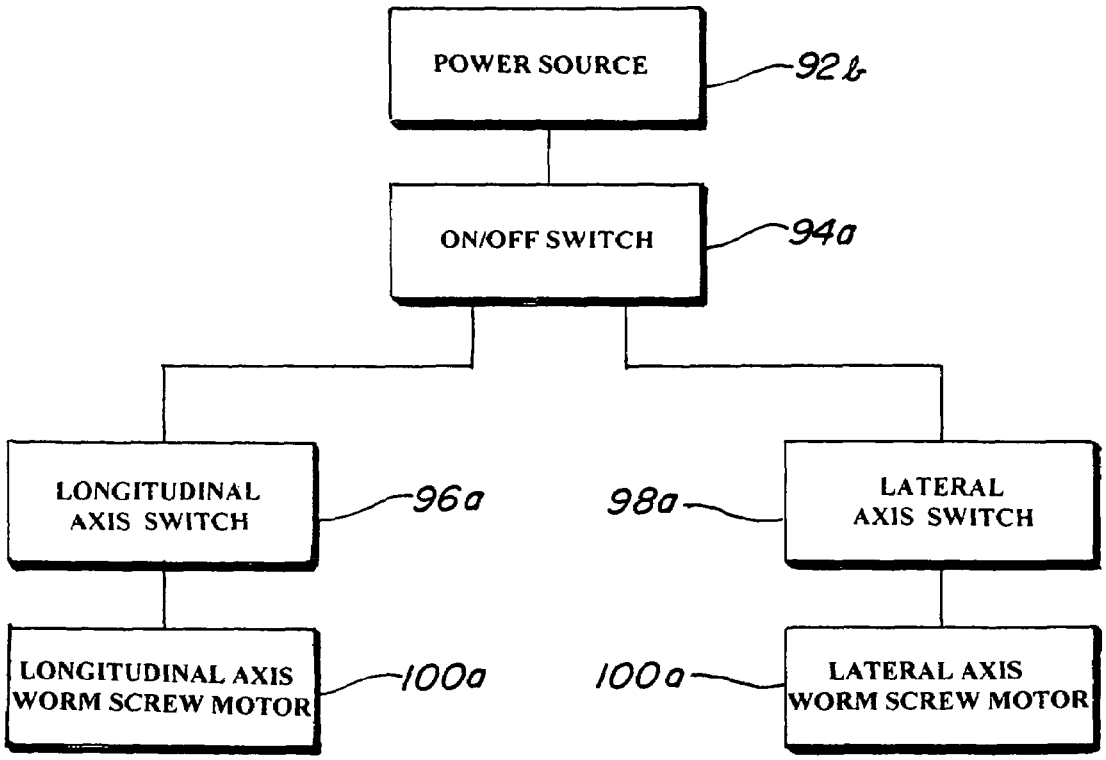
FIG. 21 is a block diagram of the electrical switch gear for actuating the articulating means in the worm screw embodiment.

The articulating platform 20 in the preferred embodiment includes manual controls for initiating directional articulation which require electrical switchgear in the form of electrical switches. The electrical switches are disposed in an electrical switch gear repository 90 that is positioned in a suitable location on the exercise bicycle 22, such as on the handlebars, as shown in FIG. 1. The switchgear, as shown in FIG. 9, includes a power source battery 92*c*, that is used in the preferred D.C. motor drive system. In the form of a schematic diagram, FIG. 20 illustrates the switchgear for the gear motor chain drive system, and FIG. 21 illustrates a worm screw drive system. Both of the latter drives are depicted in block form. The switchgear required for the latter drives include, but are not limited to, a power source 92, an on/off switch 94, a longitudinal axis switch 96, and a lateral axis switch 98 and drive motors 100 for the appropriate drive, with the suffix "a" designated on the drawings for the worm gear embodiment.

Figure 22:
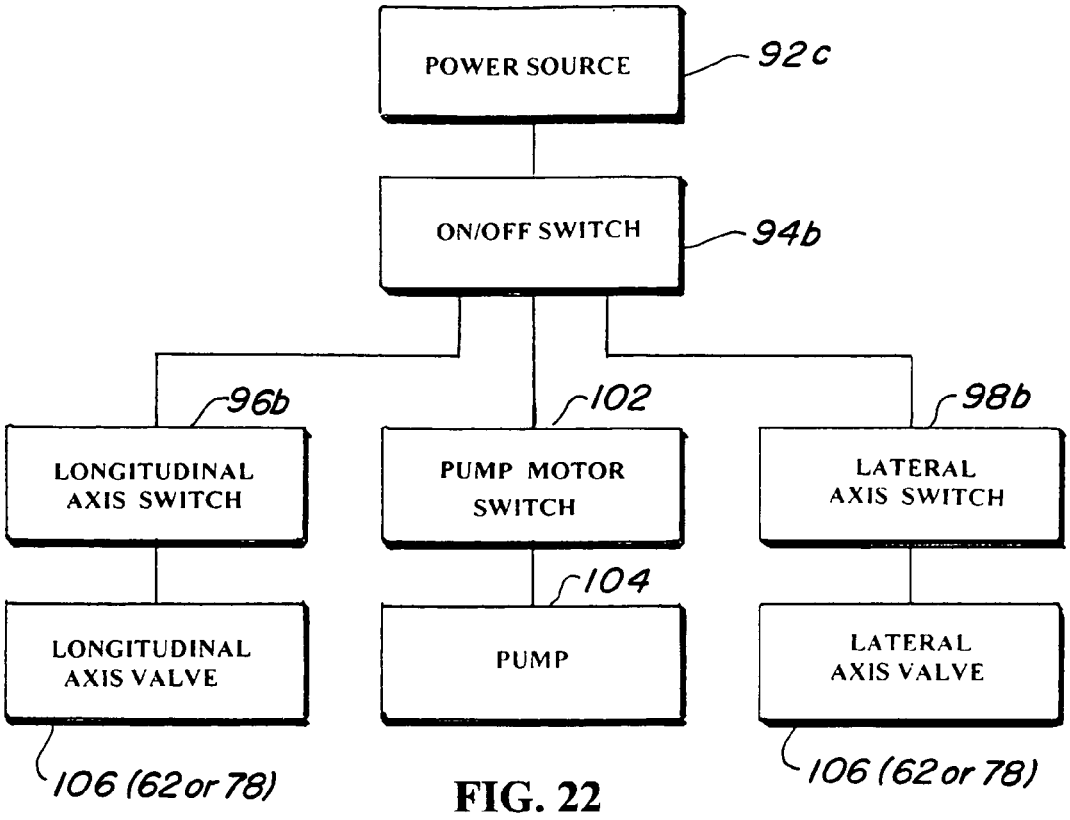
FIG. 22 is a block diagram of the electrical switch gear for actuating the articulating means in the pneumatic and hydraulic embodiments.

FIG. 22 illustrates the switchgear for both the pneumatic drive system and the hydraulic drive system in block form. The switchgear required for the above include, but are not limited to, a power source 92*b*, an off/on switch 94*b*, a longitudinal axis switch 96*b*, a lateral axis switch 98*b*, a pump motor switch 102, a pump 104 and valves 106 for the appropriate drive.

Figure 23:
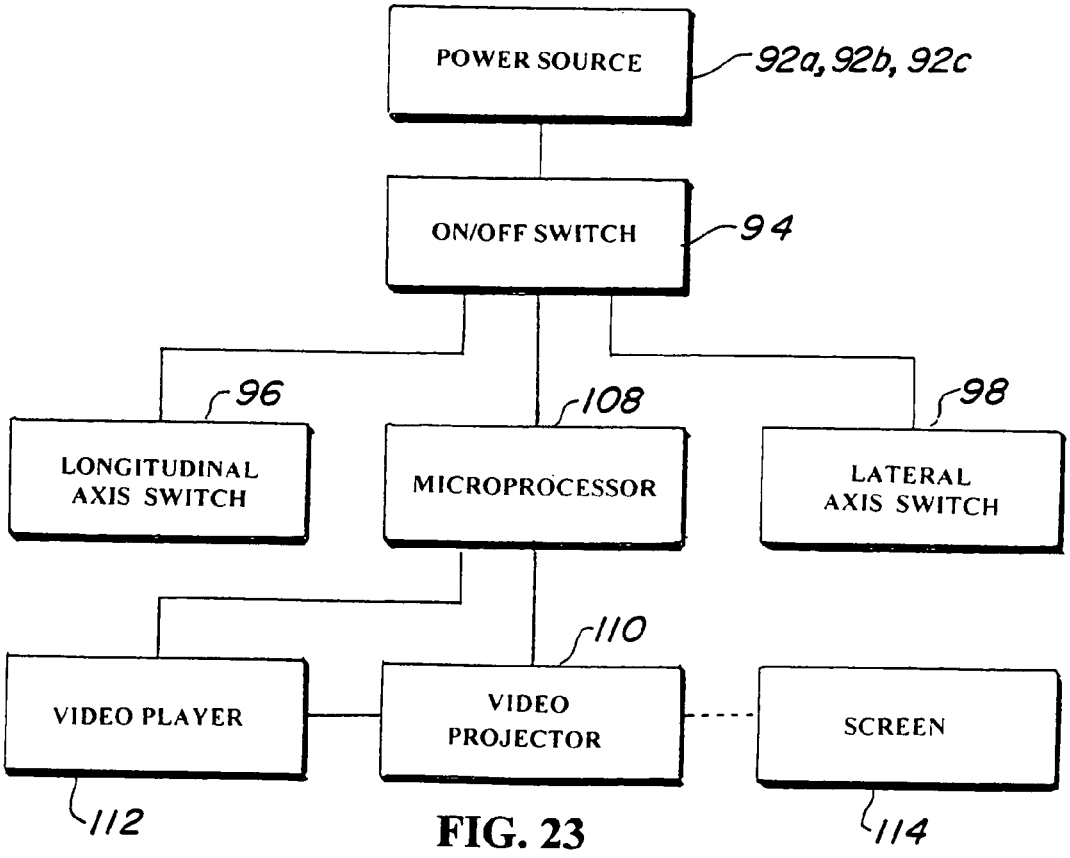
FIG. 23 is a block diagram of an optional addition to the invention which includes a microprocessor for controlling the articulating means in conjunction with a video player and projector that interfaces with the microprocessor and present recorded images on a screen, with the microprocessor synchronizing bicycle movements corresponding with the view on the screen.

An optional feature may be added to the platform 20, as shown in FIG. 23 as a block diagram. The optimal feature consists of a computer program and image visualization means that simulates bicycle rider scenic views relative to the articulating platform's position. A microprocessor 108 may be used to control the drive system in place of the manual switches. A video projector 110 that is driven by a video player 112 may interface with the microprocessor 108 to present recorded images on a screen 114 in front of the person exercising, showing a road that includes hills and curves. The microprocessor 108 synchronizes the appropriate angular movements of the bicycle 22 to correspond with the view of the road on the screen 114.

While the invention has been described in complete detail and pictorially shown in the accompanying drawings, it is not to be limited to such details, since many changes and modifications may be made to the invention without departing from the spirit and scope thereof. Hence, it is described to cover any and all modifications and forms which may come within the language and scope of the appended claims.

The invention claimed is:

1. An articulating platform for varying longitudinal and lateral angular displacement of a stationary bicycle mountable thereon, the platform comprising:

a) an articulating bicycle mounting base, having a longitudinal axis and a lateral axis, configured to accept an exercise bicycle in an upright position for a person to exercise thereon, b) pivoting means attached to said base that permit angular displacement of said base at the lateral axis for simulating uphill and downhill bicycle riding and at the longitudinal axis to simulate bicycle turning and leaning motion on a person when seated on a bike that is mounted to the base, wherein said pivoting means comprises a pivot beam having equal-length longitudinal legs and equal-length lateral legs in a single plane and in a cross shape configuration, with each of said legs arranged at right angles to each other, c) means for angularly articulating said base to pivot at said lateral axis and said longitudinal axis to simulate actual bicycle riding, including controls for initiating directional articulation, and d) a platform enclosure for supporting said articulating bicycle mounting base and providing a safety barrier for protecting moving components of the platform.

2. The articulating platform as recited in claim 1 wherein each of the lateral legs of the pivot beam includes a swiveling attachment at a distal end that rotates on a bearing plate of said platform enclosure to permit the beam to angularly rotate in a longitudinal direction, and each of the longitudinal legs of the pivot beam includes a swiveling attachment at a distal end that rotates on a bearing plate extending from the mounting base to permit the beam to angularly rotate in a lateral direction which allows for simulation of bicycle riding uphill and downhill and bicycle turning and leaning.

3. The articulating platform as recited in claim 1 further comprising electrical switchgear for actuating said means for articulating said base, including electrical switches disposed on an exercise bicycle at a suitable location.

4. The articulating platform as recited in claim 1 further comprising a computer program and image visualization means that simulate bicycle rider scenic views relative to said articulating platform's position.

5. An articulating platform for varying longitudinal and lateral angular displacement of a stationary bicycle mountable thereon, the platform comprising:

a) an articulating bicycle mounting base, having a longitudinal axis and a lateral axis, configured to accept an exercise bicycle in an upright position for a person to exercise thereon, pivoting means attached to said base that permit angular displacement of said base at the lateral axis for simulating uphill and downhill bicycle riding and at the longitudinal axis to simulate bicycle turning and leaning motion on a person when seated on a bike that is mounted to the base, wherein said pivoting means comprises a pivot beam having equal-length longitudinal legs and equal-length lateral legs in a single plane and in a cross shape configuration, with each of said legs arranged at right angles to each other, wherein said pivot beam longitudinal legs further comprise a spindle attachment on each leg distal end attached to said articulating bicycle mounting base, thus permitting the bicycle mounting base to rotate in a lateral direction from horizontal, which imitates a bicycle leaning sideways, c) means for angularly articulating said base to pivot at said lateral axis and said longitudinal axis to simulate actual bicycle riding, including controls for initiating directional articulation, and d) a platform enclosure for supporting said articulating bicycle mounting base and providing a safety barrier for protecting moving components of the platform.

6. An articulating platform for varying the longitudinal and lateral angular displacement of a stationary bicycle mountable thereon, the platform comprising:

a) an articulating bicycle mounting base, having a longitudinal axis and a lateral axis, configured to accept an exercise bicycle in an upright position for a person to exercise thereon, b) pivoting means attached to said base that permit angular displacement of said base at the lateral axis for simulating uphill and downhill bicycle riding and at the longitudinal axis to simulate bicycle turning and leaning motion on a person when seated on a bike that is mounted to the base, wherein said pivoting means comprises a pivot beam having equal-length longitudinal legs and equal-length lateral legs in a cross shape configuration, with each of said legs arranged at right angles to each other, c) means for angularly articulating said base to pivot at said lateral axis and said longitudinal axis to simulate actual bicycle riding, including controls for initiating directional articulation, and d) a platform enclosure for supporting said articulating bicycle mounting base and providing a safety barrier for protecting moving components of the platform, wherein said means for articulating said base further comprises a pneumatic drive attached between said mounting base and said pivot beam for lateral articulation, and between said pivot beam and said platform enclosure for longitudinal articulation.

7. The articulating platform as recited in claim 6 wherein said pneumatic drive further comprises an air compressor, a compressed air tank, a first air cylinder attached between said mounting base and said pivot beam, a second air cylinder attached between said pivot beam and said platform enclosure, at least one solenoid actuated valve, at least one pressure regulator, and at least one pressure switch.

* * * * *